US006694740B2

(12) United States Patent
Nayar

(10) Patent No.: US 6,694,740 B2
(45) Date of Patent: Feb. 24, 2004

(54) METHOD AND SYSTEM FOR A THERMODYNAMIC PROCESS FOR PRODUCING USABLE ENERGY

(75) Inventor: Ramesh C. Nayar, Waldorf, MD (US)

(73) Assignee: Electric Power Research Institute, Inc., Palo Alto, CA (US)

( * ) Notice: Subject to any disclaimer, the term of this patent is extended or adjusted under 35 U.S.C. 154(b) by 0 days.

(21) Appl. No.: 10/251,439

(22) Filed: Sep. 20, 2002

(65) Prior Publication Data

US 2003/0154718 A1 Aug. 21, 2003

(Under 37 CFR 1.47)

Related U.S. Application Data

(63) Continuation-in-part of application No. PCT/US02/12854, filed on Apr. 24, 2002, and a continuation-in-part of application No. 10/191,744, filed on Jul. 10, 2002, which is a continuation of application No. 10/015,552, filed on Dec. 17, 2001, which is a continuation of application No. 09/541,755, filed on Mar. 31, 2000, now abandoned, which is a continuation-in-part of application No. 09/210,953, filed on Dec. 15, 1998, now abandoned, which is a continuation-in-part of application No. 09/062,667, filed on Apr. 20, 1998, now abandoned, which is a continuation-in-part of application No. 08/832,141, filed on Apr. 2, 1997, now abandoned, application No. 10/251,439.

(60) Provisional application No. 60/323,366, filed on Sep. 20, 2001, provisional application No. 60/285,688, filed on Apr. 24, 2001, provisional application No. 60/128,423, filed on Apr. 8, 1999, provisional application No. 60/072,974, filed on Jan. 29, 1998, provisional application No. 60/060,570, filed on Sep. 30, 1997, provisional application No. 60/055,809, filed on Aug. 15, 1997, provisional application No. 60/051,677, filed on Jul. 3, 1997, provisional application No. 60/050,373, filed on Jun. 20, 1997, and provisional application No. 60/044,766, filed on Apr. 21, 1997.

(51) Int. Cl.[7] ..... F01K 25/08

(52) U.S. Cl. ..... 60/651; 60/671; 60/690

(58) Field of Search ..... 60/649, 651, 653, 60/671, 673, 691, 692, 693, 690

(56) References Cited

U.S. PATENT DOCUMENTS

| | | | | |
|---|---|---|---|---|
| 4,346,561 A | | 8/1982 | Kalina | |
| 4,489,563 A | | 12/1984 | Kalina | |
| 4,548,043 A | | 10/1985 | Kalina | |
| 4,586,340 A | | 5/1986 | Kalina | |
| 4,604,867 A | | 8/1986 | Kalina | |
| 4,729,226 A | * | 3/1988 | Rosado | 60/649 |
| 4,763,480 A | | 8/1988 | Kalina | |
| 4,765,143 A | * | 8/1988 | Crawford et al. | 60/671 |
| 4,899,545 A | | 2/1990 | Kalina | |
| 5,029,444 A | | 7/1991 | Kalina | |
| 5,038,567 A | * | 8/1991 | Mortiz | 60/641.5 |
| 5,095,708 A | | 3/1992 | Kalina | |

(List continued on next page.)

FOREIGN PATENT DOCUMENTS

WO WO 95/24822 9/1995

*Primary Examiner*—Hoang Nguyen
(74) *Attorney, Agent, or Firm*—Pennie & Edmonds LLP

(57) ABSTRACT

The present invention comprises, in one embodiment, a process for producing energy through a thermodynamic cycle comprising transforming a first working fluid having at least two components into usable energy and a first exhaust stream; diverting at least a portion of the first exhaust stream to form a diverted first exhaust stream; transferring heat from the diverted first exhaust stream to the first working fluid, thereby partially condensing the diverted first exhaust stream to form a partially condensed diverted first exhaust stream; separating the partially condensed diverted first exhaust stream into a vapor stream and a liquid stream; and transforming the vapor stream into usable energy. The present invention also comprises a system for producing energy through novel implementation of a thermodynamic cycle.

32 Claims, 5 Drawing Sheets

U.S. PATENT DOCUMENTS 5,133,190 A 7/1992 Abdelmalek
5,440,882 A 8/1995 Kalina
5,457,721 A 10/1995 Tsiklauri et al.
5,572,871 A 11/1996 Kalina
5,603,218 A * 2/1997 Hooper ..... 60/655
5,649,426 A 7/1997 Kalina et al.
5,671,601 A 9/1997 Bronicki et al.
5,816,048 A * 10/1998 Bronicki et al. ..... 60/641.5
5,822,990 A 10/1998 Kalina et al.
5,950,433 A 9/1999 Kalina
5,953,918 A 9/1999 Kalina et al.
6,032,467 A * 3/2000 Oshita et al. ..... 60/651
6,035,642 A 3/2000 Peletz, Jr. et al.
6,058,695 A 5/2000 Ranasinghe et al.
6,105,369 A 8/2000 Peletz, Jr.
6,209,307 B1 4/2001 Hartman

* cited by examiner

METHOD AND SYSTEM FOR A THERMODYNAMIC PROCESS FOR PRODUCING USABLE ENERGY

This application is a continuation-in-part of and claims priority under 35 U.S.C. §120 of: International Application No. PCT/US02/12854, filed Apr. 24, 2002; and U.S. patent application Ser. No. 10/191,744, filed Jul. 10, 2002 in the name of Ramesh C. Nayar, pending; which is a continuation-in-part of U.S. patent application Ser. No. 10/015,552, filed Dec. 17, 2001, pending; which is a continuation of U.S. patent application Ser. No. 09/541,755, filed Mar. 31, 2000, abandoned; which is a continuation-in-part of U.S. patent application Ser. No. 09/210,953, filed Dec. 15, 1998, abandoned; which is a continuation-in-part of U.S. patent application Ser. No. 09/062,667, filed Apr. 20, 1998, abandoned; which is a continuation-in-part of U.S. patent application Ser. No. 08/832,141, filed Apr. 2, 1997, abandoned. The contents of each of these applications are incorporated herein by reference in their entirety.

This application claims benefit under 35 U.S.C. §119 of U.S. Provisional Application No. 60/323,366, filed Sep. 20, 2001 in the name of Ramesh C. Nayar; and of U.S. Provisional Application No.: 60/285,688, filed Apr. 24, 2001; No. 60/128,423, filed Apr. 8, 1999; No. 60/072,974, filed Jan. 29, 1998; No. 60/060,570, filed Sep. 30, 1997; No. 60/055,809, filed Aug. 15, 1997; No. 60/051,677, filed Jul. 3, 1997; No. 60/050,373, filed Jun. 20, 1997; and No. 60/044,766, filed Apr. 21, 1997, the benefit of which is claimed in corresponding U.S. Applications cited above. The contents of each of these applications are incorporated herein by reference in their entirety.

BACKGROUND OF THE INVENTION

1. Field of the Invention

The present invention relates to a process and system for producing energy through a thermodynamic cycle. Specifically, the invention relates to a process and a system for implementing a thermodynamic cycle that utilizes a working fluid having at least two components, wherein at least a portion of an exhaust stream from at least one turbine in a turbine train is diverted to heat a feed stream to a heater that provides additional heat to the feed stream prior to it entering the turbine train. This portion of the exhaust stream is thereby partially condensed, and the liquid is removed to form a vapor stream that is returned as feed to a subsequent or downstream turbine in the turbine train for further expansion.

2. Description of Related Art

In Rankine cycles for power generation applications, the conventional working fluid is superheated steam created by the evaporation of water. The heat requirement for evaporation of water is usually large, and the liquid-to-vapor phase change requires a large amount of thermal energy. A proportion of the latent heat is recovered by extracting steam from the turbine stages following expansion and using it to preheat the boiler feed water. This is sometimes referred to as regenerative heating. The final discharge steam usually passes to a condenser and remaining latent heat is removed by cooling water and is not converted into usable energy. The extent of this unrecovered latent heat is one of the factors limiting steam cycle efficiency.

Higher steam pressures generally result in higher cycle efficiency, but since these higher pressures also increase the boiling point of the water, the temperature of the medium providing the heat also has to be at a higher temperature.

This means that regenerative heating using extraction steam is limited mainly to heating water with very little potential for generating steam.

Using a multi-component working fluid in a Rankine cycle that consists of two or more components having suitable thermodynamic and solubility characteristics, such as an ammonia/water vapor mixture, offers advantages over water/steam alone. The heat required for evaporation of ammonia/water is lower than that of water, so less energy is required to evaporate the liquid working fluid. Also, the boiling point of ammonia/water is lower than that of water, thus allowing regenerative heating to supply more of the evaporative duty to produce the final working fluid. As more of the latent heat is used for heating the ammonia/water working fluid, less energy is rejected in the condenser and the cycle efficiency is increased. The mixture used usually is ammonia rich, but the exact concentration used will depend upon the operating characteristics of the cycle employed.

Various attempts have been made to improve efficiencies of thermodynamic cycles, such as Rankine cycles using ammonia/water vapor mixtures as working fluids. For example, U.S. Pat. No. 4,899,545 (the '545 patent), incorporated herein by reference in its entirety, discloses a method and apparatus for implementing a thermodynamic cycle that includes the use of a composite stream having a higher content of a high-boiling component than a working stream to provide heat needed to partially evaporate the working stream. The working stream, after being partially evaporated, is completely evaporated with heat provided by returning gaseous working streams and heat from an auxiliary steam cycle. The working stream is then superheated and expanded in a turbine, with the expanded stream separated into a spent stream and a withdrawal stream. The withdrawal stream is combined with a lean stream to produce the composite stream, which partially evaporates the working stream and preheats the working stream and the lean stream. A first portion of the composite stream is fed into a distillation tower, from which a liquid stream flows and forms the lean stream. A second portion of the composite stream is combined with a vapor stream from the distillation tower to form a pre-condensed working stream, which is condensed to form a liquid working stream, which is preheated and partially evaporated to complete the cycle.

Thus, as disclosed in the '545 patent, in an effort to achieve the alleged efficiency increase, a withdrawal stream is separated from the expanded stream, and an elaborate process, including combination of the withdrawal stream with a lean stream and use of a distillation tower, is employed to fully condense the withdrawal stream before sending it back as part of the working fluid.

U.S. Pat. No. 5,095,708 (the '708 patent), incorporated by reference in its entirety, discloses a method and apparatus for converting thermal energy into electric power by expanding a high pressure gaseous working stream and producing a spent stream. The spent stream is condensed to form a condensed stream, which is then separated into a rich stream having a higher percentage of a low-boiling component and a lean stream having a lower percentage of the low-boiling component. The rich and lean streams each pass through a boiler, generating evaporated rich and lean streams, which are then combined to form the high pressure gaseous working stream. The '708 patent alleges that the generation of two multi-component working streams allows for a better match of the required and available heat in the process, thus increasing thermal efficiency.

The foregoing technologies are complex and involve extensive modifications to be incorporated into standard boiler designs. Moreover, the efficiency gains offered by these technologies are considered insufficient to encourage general commercial acceptance. Therefore, there is still a need for a process and system for producing usable energy using a thermodynamic cycle in a more efficient and cost-effective manner. Furthermore, there is a need for a process and system for producing usable energy that can easily be adapted to use currently available systems, equipment and apparatus of existing thermodynamic cycles.

SUMMARY OF THE INVENTION

Accordingly, the present invention provides a process and system for producing usable energy through a thermodynamic cycle. The process and system produce usable energy, such as mechanical and electrical forms of energy, through novel implementation of a thermodynamic cycle that utilizes a working fluid having at least two components.

A specific feature of the present invention is a reduction or removal of condensate or moisture from an exhaust stream, or portion thereof, from a turbine or expansion stage within a turbine train. This allows the resulting vapor stream to be further expanded and provides additional heat to the feed stream or working fluid, thereby improving overall cycle efficiency. Thus, one feature of the present invention is that it may improve thermodynamic efficiencies using currently existing systems and equipment. Also, the present invention may be incorporated into new designs.

These benefits are provided by the present invention, which, in one embodiment, comprises a process for producing energy through a thermodynamic cycle comprising transforming a first working fluid having at least two components into usable energy and a first exhaust stream; diverting at least a portion of the first exhaust stream to form a diverted first exhaust stream; transferring heat from the diverted first exhaust stream to the first working fluid, thereby partially condensing the diverted first exhaust stream to form a partially condensed diverted first exhaust stream; separating the partially condensed diverted first exhaust stream into a vapor stream and a liquid stream; and transforming the vapor stream into usable energy. The present invention also comprises a system for producing energy through novel implementation of a thermodynamic cycle.

Other benefits and features of the invention will appear from the following description from which the preferred embodiments are set forth in detail in conjunction with the accompanying drawings.

DETAILED DESCRIPTION OF THE PREFERRED EMBODIMENTS

Figure 1:
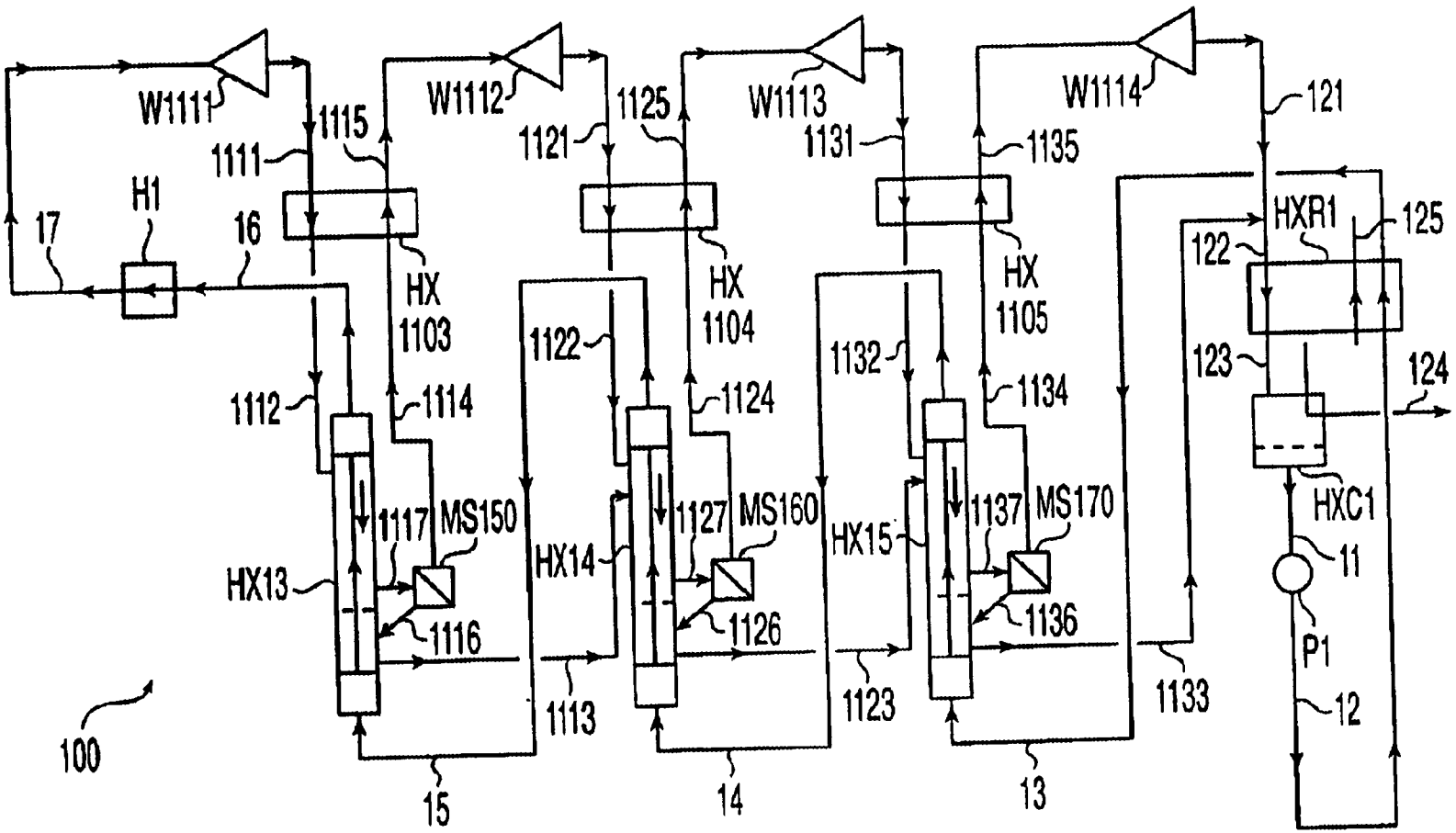
FIG. 1 illustrates a process flow schematic of a main thermodynamic cycle for producing usable energy according to one embodiment of the present invention.

Generally, the present invention encompasses a process and system for producing usable energy through a thermodynamic cycle. The process and system produce usable energy, such as mechanical and electrical forms of energy, through novel implementation of a thermodynamic cycle.

As used herein, the term "fluid" is used generically and may be used to describe a fluid that is either a gas or vapor, a liquid, or a combination thereof. It should be appreciated that the use of the term "stream" is also used generically and may be used to represent a gas or vapor stream, a liquid stream or a combination thereof. Further, the terms "fluid" and "stream" may be used interchangeably.

As used herein, "working fluid" or "working stream" refers to the medium used to implement a thermodynamic cycle. Therefore, the term "working fluid" may be used to refer generally to all or any of the streams and fluids that comprise the essentially closed-loop thermodynamic process. In addition, other terms may be used to refer to specific streams in the process that are working fluid streams. For example, the term "feed stream" may refer to any stream or fluid that feeds a particular piece of equipment in the thermodynamic cycle, such as a feed stream to a heat exchanger or a turbine. "Feed stream" may also be used to characterize streams that are being prepared for use in a turbine, such as streams that are pre-heated, evaporated, and/or superheated and that enter a turbine or turbine train. For example, in some cases, the terms "feed stream" or "feed stream to the turbine train" is used to designate the working fluid that passes through multiple heat exchangers or heaters before being fed to the first turbine in a turbine train.

As used herein, a "turbine train" refers to a series of one or more turbines wherein the exhaust stream, or a portion thereof, from one turbine is used as feed to the next downstream turbine in the series. Each turbine thereafter in the series also uses the exhaust, or a portion thereof, from an immediately preceding or upstream turbine in the series. Generally, however, the first turbine in the train would not utilize exhaust directly from another turbine, and, similarly, the exhaust stream from the last turbine in the train would not be used as feed to another turbine.

As used herein, "exhaust stream" or "exhaust fluid" means the working fluid that has been expanded in a turbine and that is exiting the turbine. "Spent stream/fluid" or "expanded stream/fluid" are also used interchangeably with "exhaust stream/fluid."

As discussed in more detail further below, in general, the invention encompasses a process and system for producing energy through a thermodynamic cycle having a working fluid that comprises at least two components, for example, a mixture of ammonia and water, wherein at least a portion of one or more exhaust streams from one or more turbines in a turbine train in the cycle are used to provide heat to the feed stream to a heater that provides additional heat to the feed stream from a separate heat source prior to entering the turbine train.

It should be appreciated that the feed stream is that portion of the working fluid that has been collected in a condenser after being used throughout the cycle and that is being returned to the heater. Before being fed to the first turbine in the turbine train, however, this feed stream must pumped to an initial working pressure and heated to vaporize the working fluid and, in some cases, to superheat the working fluid. More specifically, the heat from the exhaust streams, or portions thereof, is transferred to the feed stream using heat exchangers to heat the feed stream before it enters the heater, which is used to provide whatever additional heat is necessary to attain the desired conditions for the feed to the first turbine in the turbine train. As will be discussed below, this heater provides additional heat from a separate heat source that may comprise, for example, a fossil or renewable fuel-fired heat source, a nuclear power heat source, a geothermal heat source, a solar energy heat source, a waste heat recovery source, and combinations of any of the foregoing. In a preferred embodiment, this heat source may comprise a separate thermodynamic cycle.

A feature of the present invention is that at least a portion of an exhaust stream, or the entire exhaust stream, from at least one turbine in a turbine train, is used to provide heat to the feed stream, thereby partially condensing and forming a vapor stream and a liquid stream and returning this vapor stream to the turbine train for further expansion and production of usable energy. The liquid stream is ultimately returned as part of the feed stream to the turbine train. Specifically, the vapor stream is returned as feed to the next turbine immediately downstream of the turbine from which the exhaust stream originated. In those instances where only a portion of an exhaust stream is used to heat the feed stream, the returning vapor stream may be combined with the remainder of the original exhaust stream as feed to the next downstream turbine.

The present invention takes advantage of the thermodynamic properties of working fluids that comprise at least two components, such as vapor/liquid equilibrium properties, so that the exhaust stream from at least one of the turbines in a turbine train, or a portion thereof, upon heating the feed stream results in a vapor stream having sufficient heat and pressure to allow further expansion of that vapor stream in a subsequent turbine under thermodynamically favorable conditions, thereby producing additional usable energy and an increase in the overall thermodynamic cycle efficiency. Specifically, the working fluid may be any composition that comprises at least two components that are soluble together and that have favorable thermodynamic characteristics. For example, the working fluid should comprise at least one component that has a boiling point that is relatively lower than the another component such that subsequent expansion of the vapor stream is thermodynamically or economically efficient.

As noted, in a preferred embodiment, the invention further provides that heat from another separate thermodynamic cycle, such as a water/steam Rankine cycle, may be used to heat the feed stream for the turbine train in the thermodynamic cycle using a working fluid that comprises at least two components, such as an ammonia/water Rankine cycle, as described above. The use of two thermodynamic cycles may be referred to as a composite thermodynamic cycle. In this composite cycle, the thermodynamic cycle that utilizes a working fluid comprising at least two components, such as an ammonia/water Rankine cycle, is referred to as the "main cycle." The thermodynamic cycle that provides heat to this main cycle is referred to as the "heat-providing cycle." It should be appreciated that the heat-providing cycle may provide heat to the main cycle through one or more bleed streams taken from the turbine train associated with the heat-providing cycle; however, many additional methods for integrating the heat from a heat-providing cycle with the main cycle are possible and several of these are described in more detail below.

It should be appreciated that while the present description may refer specifically to an ammonia/water Rankine cycle as the main cycle and a water/steam Rankine cycle as the heat-providing cycle, other thermodynamic cycles may be used. For instance, any thermodynamic cycle may be used as the main cycle, provided the working fluid comprises at least two components having the proper vapor/liquid equilibrium properties to make thermodynamically efficient use of one or more exhaust streams in heating the feed stream to the turbine train and to produce a vapor stream that is returned to the turbine train. Further, the use of the term "main cycle" should not be construed as meaning that this cycle is the most preferred cycle or the largest cycle in a particular application.

It should also be appreciated that the present invention described herein may be utilized in new power plant designs or in retrofit situations. In new designs, the present invention may be designed to be utilized in any size power plant. For example, depending upon the desired power output from the power plant and the number and size of the turbines used in a turbine train, the thermodynamic processes of the present invention can be designed accordingly to provide an optimized thermodynamic process to provide such desired power output. In retrofit applications, the thermodynamic processes of the present invention can be designed to work with existing equipment and any limitations thereof. In some retrofit applications, it may be desirable to replace certain equipment to make the thermodynamic processes of the present invention more efficient.

FIG. 1 illustrates a process flow schematic of a main thermodynamic cycle for producing usable energy according to one embodiment of the present invention. In this embodiment, the main thermodynamic cycle 100 comprises any thermodynamic cycle that uses a working fluid having at least two components, such as an ammonia/water Rankine cycle, in which the full or entire exhaust stream from each turbine in a turbine train, except for the last turbine, is used to heat the working fluid or feed stream to a heater H1 that provides additional heat to the feed stream prior to entering the turbine train. As shown in FIG. 1, and as will be described below, the exhaust stream refers to the exhaust from a turbine in the turbine train, and multiple exhaust streams may be used to heat the feed stream to heater H1. It should also be appreciated that the feed stream that is heated by one or more exhaust streams from turbines in the turbine train (i.e., the feed stream to heater H1) is the working fluid from a condenser HXC1, which collects all of the working fluid that has been used throughout the cycle and that is being returned to heater H1. This feed stream should not be confused with feed streams to subsequent, downstream turbines in the turbine train.

FIG. 1 shows a main thermodynamic cycle 100, which, as noted, may be an ammonia/water Rankine cycle in which the composition of the working fluid would comprise a mixture of ammonia and water. The working fluid is represented in FIG. 1 by various streams. One flow path through the main cycle 100 for the working fluid follows streams 11–17, 1111, 1112, 1117, 1114, 1115, 1121, 1122, 1127, 1124, 1125, 1131, 1132, 1137, 1134, 1135, and 121–123. Other steams that represent the working fluid in the main cycle 100 include streams 1116, 1113, 1126, 1123, 1136, and 1133.

For discussion purposes, the path of the working fluid may be construed to start in the main cycle 100 in liquid form in the condenser HXC1, where stream 124 represents cooling media or cooling water for condenser HXC1. Overall, in the main cycle 100, this working fluid is converted to a vapor, which may be superheated to different degrees, before entering the turbine train, which comprises individual turbines in series W1111, W1112, W1113, and W1114, for expansion and production of usable energy.

While four turbines are shown in this embodiment, it should be appreciated that the number of turbines in the turbine train may be more or less. For example, the present invention is also applicable to one, two, three, five, or more turbines in a turbine train.

In this embodiment, the working fluid exits the condenser HXC1 as stream 11 and passes through a pump P1 to form stream 12. Stream 12 may first pass through heat exchanger HXR1 in which heat is transferred from stream 122, which is the combination of the exhaust stream 121 exiting the last turbine W1114 in the turbine train and liquid stream 1133, to form working fluid stream 123. Heat exchanger HXR1 is optional, and its use can be determined based upon the overall thermodynamics of the cycle 100. For example, if stream 122 contains enough heat to heat stream 12 by a predetermined amount, stream 122 may additionally be used to heat stream 125, which generically represents any stream requiring heat in this process or a nearby or separate process. For example, stream 125 may represent combustion air to a boiler or cooling water.

The working fluid represented by stream 13 then passes through a series of heat exchangers HX15, HX14, and HX13 and heater H1 before entering the first turbine W1111 in the turbine train. These heat exchangers HX15, HX14, and HX13 and heater H1 transfer heat to the working fluid that feeds the turbine train to provide a working fluid represented by stream 17 having a desired or predetermined set of conditions, including, for example, a predetermined temperature and pressure.

One of skill in the art will appreciate how to determine the desired conditions for stream 17 and, therefore, the amount of heat required to be provided to the feed stream. For example, the desired temperature and pressure of stream 17 should be selected so that the main thermodynamic cycle 100 is optimized, which can be based upon maximizing efficiency or minimizing costs. The composition of the working fluid, the equipment used in the process, and the process flow rates and conditions (e.g., temperature and pressure) must all be taken into account in optimizing the cycle 100 and, therefore, in determining the amount of heat to be provided by heat exchangers HX15, HX14, and HX13 and heater H1. For example, it may be desirable in some situations to transfer enough heat to the feed stream such that stream 17 is superheated to a degree to minimize or reduce the amount of condensation in a particular turbine in the turbine train.

Once the desired amount of heat to be transferred to the feed stream to the turbine train is determined, each of the heat exchangers HX13, HX14, and HX15, can readily be designed based upon, for example, the properties of the streams used in each heat exchanger, such as composition, temperature, pressure, and flow rates. One of skill in the art will appreciate that these heat exchangers may be of any type or design, including, for example, a shell and tube heat exchanger design typically used for steam feedwater heaters. Therefore, it should be appreciated that while FIG. 1 shows heat exchangers HX15, HX14, and HX13 as vertical heat exchangers having a given liquid level shown by the dotted lines in each, any appropriate type of heat exchanger positioned in an appropriate orientation may be used. In retrofit applications, the design of the main cycle 100 will be influenced by existing equipment that is used.

In the embodiment shown in FIG. 1, streams 13–17 represent the feed stream to the turbine train that is heated prior to being fed to the first turbine W1111 according to the present invention. Specifically, stream 13 passes through heat exchanger HX15, which transfers heat from streams 1132 and 1123 to stream 13, thereby forming stream 14. Similarly, stream 14 passes through heat exchanger HX14, which transfers heat from streams 1122 and 1113 to stream 14, thereby forming stream 15. Heat exchanger HX13 then transfers heat from stream 1112 to stream 15, thereby forming stream 16. Heater H1 transfers heat to stream 16 to form stream 17, which enters the first turbine W1111 in the turbine train.

Heater H1 represents a heater that provides heat to stream 16 from a generic heat source, thereby forming stream 17. Such heat sources may include, for example, a fossil or renewable fuel-fired heat source, a nuclear-power heat source, a geothermal heat source, a solar energy heat source, a waste heat recovery source, and combinations of any of the foregoing. More specifically, heater H1 may be a boiler using any type of fuel through which stream 16 directly passes, or heater H1 may be one or more heat exchangers that transfer heat from any other stream to stream 16, such as, for example, a heat exchanger that passes heat from steam generated in a boiler to stream 16. As will be discussed in more detail below, in a preferred embodiment, heater H1 may be another thermodynamic cycle that passes heat through a heat exchanger to stream 16.

The amount of heat required to be provided by heater H1 is dependent upon the design and optimization of the main cycle 100. For example, depending upon the amount of heat transferred to the feed stream through heat exchangers HX13, HX14, and HX15, heater H1 is then used to provide the additional heat required.

Feed stream 17 is then expanded in the first turbine W1111 in the turbine train, which produces usable energy (not shown). As noted above, the full exhaust stream from each of the turbines in the turbine train is used or diverted to heat the feed to heater H1. With respect to the first turbine W1111, the full exhaust stream 1 from the first turbine W1111 in the turbine train is diverted. It should be appreciated that the use of the term "diverted" in connection with FIG. 1 means simply that, for example, the full exhaust stream 1111 is passed to another part of the process, for example, instead of passing the exhaust stream 1111 to the next downstream turbine.

Stream 1111 is passed to heat exchanger HX1103, which may be used to transfer heat to the returning vapor stream 1114 from exhaust stream 1111, thereby forming stream 1112. It should be appreciated that the use of heat exchanger HX1103 is optional and is discussed in more detail below. Stream 1112 enters heat exchanger HX13 and heat is transferred to feed stream 15, thereby forming feed stream 16. Upon transferring heat to stream 15, stream 1112 is partially condensed in the heat exchanger HX13 and separated into vapor stream 1117 and liquid stream 1113.

It should be appreciated that vapor stream 1117 may still retain some moisture or liquid. Therefore, the separation of partially condensed stream 1112 into vapor stream 1117 and liquid stream 1113 may not result in a total or complete separation of vapor and liquid, and the use of the term "vapor stream" should not be construed as meaning a moisture-free vapor. However, it is desirable to minimize the amount of moisture or liquid in vapor stream 1117, which allows the resulting vapor stream to be further expanded in a subsequent turbine to produce usable energy with good expansion efficiency and with reduced potential for erosion damage. Such further expansion increases the usable energy produced by the thermodynamic cycle of the present invention as well as its thermodynamic efficiency.

To reduce or minimize the amount of moisture or liquid in vapor stream 1117, it is sent to a moisture separator MS150 in which any remaining liquid is separated and sent back to heat exchanger HX13 as liquid stream 1116. Vapor stream 1117 then continues as vapor stream 1114. It should be appreciated that moisture separator MS150, as well as moisture separators MS160 and MS170, discussed below, are any device known in the art capable of separating liquid droplets or moisture from a vapor stream. For example, while moisture separators MS150, MS160, and MS170 are shown as separate components, each may be integral components of heat exchangers HX13, HX14, and HX15, respectively. Further, heat exchanger HX13 may be designed in such a manner to effectively separate partially condensed stream 1112 into liquid stream 1113 and vapor stream 1117, where vapor stream 1117 has a relatively low or acceptable amount of moisture, which would obviate the need for moisture separator MS150. The same is equally applicable to heat exchangers HX14 and HX15 and moisture separators MS160 and MS170, respectively, and their associated partially condensed streams, liquid streams, and vapor streams. Therefore, the use of moisture separators MS150, MS160, and MS170 is optional and will depend, at least in part, upon the moisture content of the respective vapor streams 1117, 1127, and 1137 and the desired operating conditions for each turbine that is fed by these streams.

It should be appreciated that the partial condensation of stream 1112, and the separation of liquid from this partially condensed stream to form vapor stream 1117/1114 results in a change in the composition of vapor stream 1117/1114 relative to the exhaust streams feeding heat exchanger HX13. For example, in ammonia/water systems, the ammonia content is increased in vapor stream 1117/1114. As noted, working fluids capable of being used in the present invention comprise at least two components and have favorable thermodynamic properties, such as favorable vapor/liquid equilibrium properties that provide for such a change in composition upon separation of the partially condensed stream into a vapor stream and a liquid stream. Again, this allows for further expansion of the vapor stream and further heating of the feed stream by subsequent exhaust streams, thus increasing overall cycle efficiency. The same is equally applicable to streams 1127/1124 and 1137/1134.

As noted above, optional heat exchanger HX1103 may be used to transfer heat from diverted exhaust stream 1111 to vapor stream 1114, thereby forming vapor stream 1115. The use of heat exchanger HX1103 is determined based upon optimization of the thermodynamic cycle 100 and other system design criteria. For example, heat transferred in heat exchanger HX1103 may be used to evaporate and remove or at least reduce the amount of moisture in vapor stream 1114 before it enters the next downstream turbine W1112 as vapor stream 1115. Therefore, the use of heat exchanger HX1103 may be determined in part by the use of moisture separator MS150.

After exiting from heat exchanger HX1103, if used, vapor stream 1115 is used as feed to the second turbine W1112 in the turbine train. Vapor stream 1115 is then expanded in the second turbine W1112 to produce usable energy (not shown) and another exhaust stream 1121. As with the first diverted exhaust stream 1111, full exhaust stream 1121 is also diverted.

Stream 1121 is passed to heat exchanger HX1104, which may be used to transfer heat to the returning vapor stream 1124 from exhaust stream 1121, thereby forming stream 1122. It should be appreciated that the use of heat exchanger HX1104 is optional and is discussed in more detail below. Exhaust stream 1122 is then directed to another heat exchanger HX14. The liquid stream 1113 from the first heat exchanger HX13 is also sent as feed to HX14 along with the exhaust stream 1122. Optionally, these streams may be combined prior to entering heat exchanger HX14, or they may be fed separately to heat exchanger HX14. Diverted exhaust stream 1122 and the liquid stream 1113 from heat exchanger HX13 are used in heat exchanger HX14 to transfer heat to feed stream 14, thereby producing feed stream 15. Similarly to heat exchanger HX13, partial condensation of exhaust stream 1122 occurs in heat exchanger HX14, and vapor stream 1127 and liquid stream 1123 are produced. Also, similar thermodynamic benefits, as discussed above in connection with heat exchanger HX13, are obtained to allow for further expansion of the working fluid.

As discussed above in connection with moisture separation MS150, moisture separator MS160 may optionally be used to remove, or at least reduce the amount of any remaining liquid in vapor stream 1127, thereby forming vapor stream 1124, and such liquid is sent back to heat exchanger HX14 as liquid stream 1126. The use of moisture separation MS160 is based upon the same criteria discussed in connection with moisture separation MS150.

As noted above, optional heat exchanger HX1104 may be used to transfer heat from diverted exhaust stream 1121 to vapor stream 1124, thereby forming vapor stream 1125. The use of heat exchanger HX1104 is determined based upon the same criteria as described in connection with heat exchanger HX1103.

After exiting from heat exchanger HX1104, if used, vapor stream 1125 is used as feed to the third turbine W1113 in the turbine train. Vapor stream 1125 is then expanded in the third turbine W1113 to produce usable energy (not shown) and another exhaust stream 1131. As with the previous diverted exhaust streams 1111 and 1121, full exhaust stream 1131 is also diverted.

Stream 1131 is passed to heat exchanger HX1105, which may be used to transfer heat to the returning vapor stream 1134 from exhaust stream 1131, thereby forming stream 1132. It should be appreciated that the use of heat exchanger HX1105 is optional and is discussed in more detail below. Exhaust stream 1132 is then directed to another heat exchanger HX15. The liquid stream 1123 from the second heat exchanger HX14 is also sent as feed to HX15 along with the exhaust stream 1132. Optionally, these streams may be combined prior to entering heat exchanger HX15, or they may be fed separately to heat exchanger HX15. Diverted exhaust stream 1132 and the liquid stream 1123 from heat exchanger HX14 are used in heat exchanger HX15 to transfer heat to the feed stream 13, thereby producing feed stream 14. Similarly to heat exchangers HX13 and HX14, a vapor stream 1137 and a liquid stream 1133 are produced by heat exchanger HX14. Similarly to heat exchangers HX13 and HX14, partial condensation of exhaust stream 1132 occurs in heat exchanger HX15, and vapor stream 1137 and liquid stream 1133 are produced. Also, similar thermodynamic benefits, as discussed above in connection with heat exchangers HX13 and HX14, are obtained to allow for further expansion of the working fluid.

As discussed above in connection with moisture separation MS150, moisture separator MS170 may optionally be used to remove, or at least reduce the amount of any remaining liquid in vapor stream 1137, thereby forming vapor stream 1134, and such liquid is sent back to heat exchanger HX15 as liquid stream 1136. The use of moisture separation MS170 also provides similar benefits to those described above in connection with moisture separators MS150 and MS160.

As noted above, optional heat exchanger HX1105 may be used to transfer heat from diverted exhaust stream 1131 to vapor stream 1134, thereby forming vapor stream 1135. The use of heat exchanger HX1105 is determined based upon the same criteria as described in connection with heat exchangers HX1103 and HX1104.

After exiting from heat exchanger HX1105, if used, vapor stream 1135 is used as feed to the fourth and final turbine W1114 in the turbine train. Vapor stream 1135 is then expanded in the fourth turbine W1114 to produce usable energy (not shown) and another exhaust stream 121. The full exhaust stream 121 is then combined with liquid stream 1133 from heat exchanger HX15 to form stream 122. As noted, if optional heat exchanger HXR1 is used, heat is extracted from stream 122, thereby forming stream 123, which enters the condenser HXC1 to complete the main cycle 100.

It should be appreciated in connection with FIG. 1 that the process shown is exemplary. The process may contain more or less turbines in the turbine train. For example, the main cycle 100 may also be adapted for use with one, two, three, five, or more turbines in the turbine train. In the case of one turbine, it would generally be operated in a manner similar to turbine W1111 in FIG. 1 with one exhaust stream being sent to a heat exchanger to heat the feed stream. In the case of two or three turbines, each would also be generally operated similarly to turbines W1111–W1113 in FIG. 1, thereby providing two or three exhaust streams to be diverted to respective heat exchangers to heat the feed stream, depending upon whether the last turbine in the turbine train is used to heat the feed stream or not. In the case of five or more turbines, the additional turbines would generally be operated in a manner similar to turbines W1112 or W1113 in FIG. 1, thereby providing four or more turbine exhaust streams to be diverted to respective heat exchangers to heat the feed stream to the turbine train.

Further, it may not be necessary that the exhaust stream from each turbine be diverted to a heat exchanger to heat the feed stream to heater H1. For example, in some cases, it may be more thermodynamically efficient or more cost effective to simply pass the exhaust stream from one or more turbines to the next downstream turbine directly. In such instances, moisture may need to be separated from the exhaust stream prior to it entering the next turbine.

It should be appreciated that the specific process operating conditions for the invention of FIG. 1 will be based upon each specific application. For example, overall process design, including process operating conditions such as stream flow rates, compositions, temperatures and pressures, as well as equipment design, will all be determined based upon optimization of thermodynamic efficiency or costs for each specific application, new or retrofit. Further, such design will also be based upon the thermodynamic properties of the specific working fluid used in the process. As one of skill in the art will appreciate, various factors may be limiting in such designs, such as existing equipment, and may dictate the use of certain designs and operating conditions to accommodate such limitations.

Figure 2:
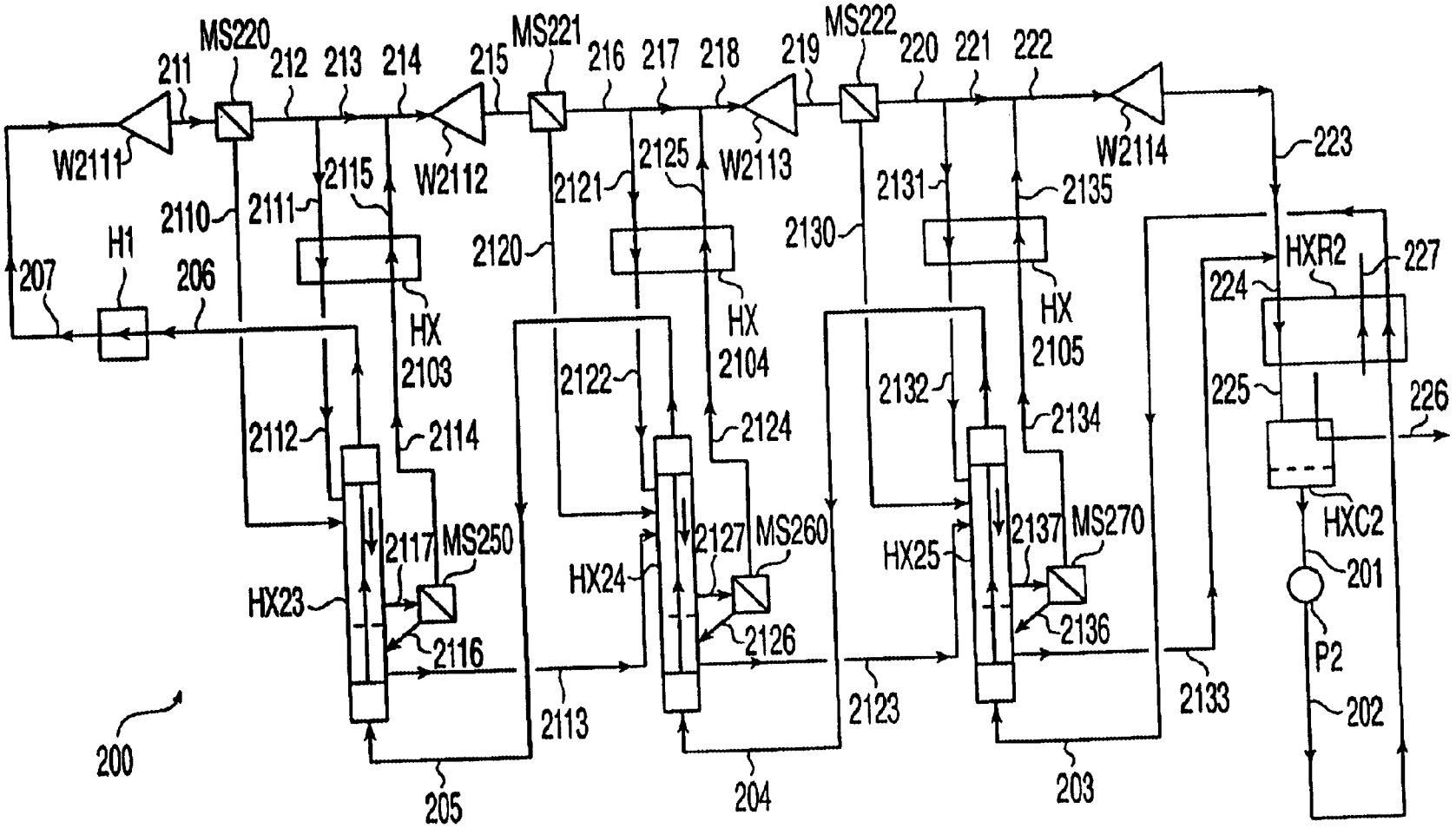
FIG. 2 illustrates a process flow schematic of a main thermodynamic cycle for producing usable energy according to another embodiment of the present invention.

FIG. 2 illustrates a process flow schematic of a main thermodynamic cycle for producing usable energy according to another embodiment of the present invention. The thermodynamic process 200 is generally the same as that shown in FIG. 1, except for two process changes. First, only a portion of, or bleed stream from, each exhaust stream from certain turbines in the turbine train is diverted to a respective heat exchanger to heat the feed stream to heater H1, which provides additional heat to the feed stream prior to entering the turbine train. Second, optional moisture separators MS220, MS221, and MS222 used at the outlet of each turbine, which may be any device known in the art capable of separating liquid droplets or moisture from a vapor stream. Therefore, the discussion above in connection with FIG. 1 is equally applicable to the thermodynamic process 200 of FIG. 2 except for the differences that arise due to using only a portion of, or bleed stream from, certain turbine exhaust streams and the optional use of a moisture separator in the exhaust stream from these two process changes.

Similarly to FIG. 1, FIG. 2 provides a main thermodynamic cycle 200 that also comprises any thermodynamic cycle that uses a working fluid having at least two components, such as an ammonia/water Rankine cycle, in which a portion of the exhaust stream from each turbine in a turbine train, except for the last turbine, is used to heat the working fluid from a condenser HXC2, which collects all of the working fluid that has been used throughout the cycle and that is being returned to heater H1. The working fluid is represented in FIG. 2 by various streams. One flow path through the main cycle 200 for the working fluid follows streams 201–207, 211, 212, 2111, 2112, 2117, 2114, 2115, 213–216, 2121, 2122, 2127, 2124, 2125, 217–220, 2131, 2132, 2137, 2134, 2135, and 221–225. Other steams that represent the working fluid in the main cycle 200 include streams 2110, 2116, 2113, 2120, 2126, 2123, 2130, 2136, and 2133.

For discussion purposes, the path of the working fluid may be construed to start in the main cycle 200 in liquid form in the condenser HXC2, where stream 226 represents cooling media or cooling water for condenser HXC2. Overall, in the main cycle 200, this working fluid is converted to a vapor, which may be superheated, before entering the turbine train, which comprises individual turbines in series W2111, W2112, W2113, and W2114, for expansion and production of usable energy. While four turbines are shown in this embodiment, it should be appreciated that the number of turbines in the turbine train may be more or less. For example, the present invention is also applicable to one, two, three, five, or more turbines in a turbine train.

In this embodiment, the working fluid exits the condenser HXC2 as stream 201 and passes through pump P2 to form stream 202. Stream 202 may first pass through heat exchanger HXR2 in which heat is transferred from stream 224, which is the combination of exhaust stream 223 exiting the last turbine W2114 in the turbine train and liquid stream 2133, to form working fluid stream 225. Heat exchanger HXR2 is optional and its use can be determined based upon the overall thermodynamics of the cycle 200. For example, if stream 224 contains enough heat to heat stream 202 by a predetermined amount, stream 224 may additionally be used to heat stream 227, which generically represents any stream requiring heat in this process or a nearby or separate process. For example, stream 227 may represent combustion air to a boiler or cooling water.

The working fluid represented by stream 203 then passes through a series of heat exchangers HX25, HX24, and HX23 and heater H1 before entering the first turbine W2111 in the turbine train. These heat exchangers HX25, HX24, and HX23 and heater H1 transfer heat to the working fluid that feeds the turbine train to provide a working fluid represented by stream 207 having a desired or predetermined set of conditions, including, for example, a predetermined temperature and pressure.

One of skill in the art will appreciate how to determine the desired conditions for stream 207 and, therefore, the amount of heat required to be provided to the feed stream. For example, the desired temperature and pressure of stream 207 should be selected so that the process 200 is optimized, which can be based on either maximizing efficiency or minimizing costs. The composition of the working fluid, the equipment used in the process, and the process flow rates and conditions (e.g., temperature and pressure) must all be taken into account in optimizing the cycle 200 and, therefore, in determining the amount of heat to be provided by heat exchangers HX25, HX24, and HX23 and heater H1. For example, it may be desirable in some situations to transfer enough heat to the feed stream such that stream 207 is superheated to a degree to minimize or reduce the amount of condensation in a particular turbine in the turbine train.

Once the desired amount of heat to be transferred to the feed stream to the turbine train is determined, each of the heat exchangers HX23, HX24, and HX25, can readily be designed based upon, for example, the properties of the streams used in each heat exchanger, such as composition, temperature, pressure, and flow rates. One of skill in the art will appreciate that these heat exchangers may be of several types or design, including, for example, a shell and tube heat exchanger design typically used for steam feedwater heaters. Therefore, it should be appreciated that while FIG. 2 shows heat exchangers HX25, HX24, and HX23 as vertical heat exchangers having a given liquid level shown by the dotted lines in each, any appropriate type of heat exchanger positioned in an appropriate orientation may be used. In retrofit applications, the design for main cycle 200 will be influenced by any existing equipment that is used. It should be appreciated that if moisture separators MS220, MS221, and MS222 are used, the respective liquid streams produced by these moisture separators 2110, 2120, and 2130 would be fed to heat exchangers HX23, HX24, and HX25, respectively.

In the embodiment shown in FIG. 2, streams 203–207 represent the feed stream to the turbine train that is heated prior to being fed to the first turbine W2111 according to the present invention. Specifically, stream 203 passes through heat exchanger HX25, which transfers heat from streams 2130, if moisture separator MS222 is used, 2132 and 2123 to stream 203, thereby forming stream 204. Similarly, stream 204 passes through heat exchanger HX24, which transfers heat from streams 2120, if moisture separator MS221 is used, 2122 and 2113 to stream 204, thereby forming stream 205. Heat exchanger HX23 then transfers heat from streams 2110, if moisture separator MS220 is used, and 2112 to stream 205, thereby forming stream 206. Heater H1 transfers heat to stream 206 to form stream 207, which enters the first turbine W2111 in the turbine train.

Heater H1 is identical to heater H1 in FIG. 1 and represents a generic heat source that transfers heat to stream 206, thereby forming stream 207, from any heat source. Such heat sources may include, for example, a fossil or renewable fuel-fired heat source, a nuclear-power heat source, a geothermal heat source, a solar energy heat source, a waste heat recovery source, and combinations of any of the foregoing. More specifically, heater H1 may be a boiler using any type of fuel through which stream 206 directly passes, or heater H1 may be one or more heat exchangers that transfer heat from any other stream to stream 206, such as, for example, a heat exchanger that passes heat from steam generated in a boiler to stream 206. As will be discussed in more detail below, in a preferred embodiment, heater H1 may be another thermodynamic cycle that passes heat through a heat exchanger to stream 206.

The amount of heat required to be provided by heater H1 is dependent upon the design and optimization of the main cycle 200. For example, depending upon the amount of heat transferred to the feed stream through heat exchangers HX23, HX24, and HX25, heater H1 is then used to provide the additional heat required.

Feed stream 207 is then expanded in the first turbine W2111 in the turbine train, which produces usable energy (not shown). As noted above, in this embodiment, only a portion of, or a bleed stream from, the exhaust stream from each of the turbines in the turbine train is diverted to heat the feed to the turbine train. The first turbine W2111 produces exhaust stream 211, which passes through moisture separator MS220 to remove or at least reduce the amount of any liquid droplets or moisture present in stream 211. The removed liquid forms stream 2110 and is sent to heat exchanger HX23 and the remaining exhaust stream forms stream 212.

It should be appreciated that the use of moisture separator MS220 is optional. Further, while shown at the outlet of turbine W2111, moisture separator MS220 may optionally be placed in other positions in the exhaust stream from turbine W2111. For example, moisture separator MS220 may be placed in stream 213 downstream of where diverted bleed stream 2111 is diverted from the exhaust stream. Alternatively, moisture separator MS220 may be placed in stream 213 downstream of where the returning vapor stream 2115 is combined with the remaining exhaust stream 213. The position of moisture separator MS220 depends upon optimization of the cycle 200 and the position where is it most efficient and advantageous to remove any liquid from the exhaust streams represented by streams 211–214 prior to entering the second turbine W2112. It should be appreciated that placing moisture separator MS220 in stream 213 may result in lower equipment cost since the flow rate of stream 213 is lower than either streams 211 or 214. However, such placement would again be determined based upon optimization of the cycle 200.

A portion of, or bleed stream from, the remaining exhaust stream 212 is then diverted as stream 2111, and the remaining exhaust stream continues as stream 213. Generally, the amount of diverted stream 2111 is determined based upon the heat duty of heat exchanger HX23. It should be appreciated that the location of moisture separator MS220, if used, may influence the amount of the diverted stream 2111 and the design of heat exchanger HX23. The diversion of stream 2111 and achieving the desired flow rate may be accomplished by any means known in the art, such as, for example, through use of an eductor, a valve arrangement, or any combination of the two.

The diverted exhaust stream 2111 is passed to heat exchanger HX2103, which may be used to transfer heat to the returning vapor stream 2114 from exhaust stream 2111, thereby forming stream 2112. It should be appreciated that the use of heat exchanger HX2103 is optional and is discussed in more detail below. Stream 2112 enters heat exchanger HX23, along with stream 2110, if moisture separator MS220 is used, and heat is transferred to feed stream 205, thereby forming feed stream 206. Optionally, these streams may be combined prior to entering heat exchanger HX23, or they may be fed separately to heat exchanger HX23. Upon transferring heat to stream 205, stream 2112 is partially condensed in heat exchanger HX23, and vapor stream vapor stream 2117 and liquid stream 2113 are produced.

As discussed above in connection with FIG. 1, it should be appreciated that this partial condensation results in a change in the composition of vapor stream 2117 and liquid stream 2113 relative to the exhaust streams feeding heat exchanger HX23. This provides favorable thermodynamic conditions that allow for further expansion of the working fluid. Similarly, it should be appreciated that vapor stream 2117 may still retain some moisture or liquid. Therefore, the separation of partially condensed stream 2112 into vapor stream 2117 and liquid stream 2113 may not result in a total or complete separation of vapor and liquid, and the use of the term "vapor stream" should not be construed as meaning a moisture-free vapor. However, it is desirable to minimize the amount of moisture or liquid in vapor stream 2117, which allows the resulting vapor stream to be further expanded in a subsequent turbine to produce usable energy with good expansion efficiency and with reduced potential for erosion damage. Such further expansion increases the usable energy produced by the thermodynamic cycle of the present invention as well as its thermodynamic efficiency.

To reduce or minimize the amount of moisture or liquid in vapor stream 2117, it is sent to a moisture separator MS250 in which any remaining liquid is separated and sent back to heat exchanger HX23 as liquid stream 2116. Vapor stream 2117 then continues as vapor stream 2114. It should be appreciated that moisture separator MS250, as well as moisture separators MS260 and MS270, discussed below, are any device known in the art capable of separating liquid droplets or moisture from a vapor stream. For example, while moisture separators MS250, MS260, and MS270 are shown as separate components, each may be integral components of heat exchangers HX23, HX24, and HX25, respectively. Further, heat exchanger HX23 may be designed in such a manner to effectively separate partially condensed stream 2112 into liquid stream 2113 and vapor stream 2117, where vapor stream 2117 has a relatively low or acceptable amount of moisture, which would obviate the need for moisture separator MS250. The same is equally applicable to heat exchangers HX24 and HX25 and moisture separators MS260 and MS270, respectively, and their associated partially condensed streams, liquid streams, and vapor streams. Therefore, the use of moisture separators MS250, MS260, and MS270 is optional and will depend, at least in part, upon the moisture content of the respective vapor streams 2117, 2127, and 2137 and the desired operating conditions for each turbine that is fed by these streams.

Also as described in connection with the cycle of FIG. 1, it should be appreciated that the partial condensation of stream 2112, and the separation of liquid from this partially condensed stream to form vapor stream 2117/2114 results in a change in the composition of vapor stream 2117/2114 relative to the exhaust streams feeding heat exchanger HX23. For example, in ammonia/water systems, the ammonia content is increased in vapor stream 2117/2114. As noted, working fluids capable of being used in the present invention comprise at least two components and have favorable thermodynamic properties, such as favorable vapor/liquid equilibrium properties that provide for such a change in composition upon separation of the partially condensed stream into a vapor stream and a liquid stream. Again, this allows for further expansion of the vapor stream and further heating of the feed stream by subsequent exhaust streams, thus increasing overall cycle efficiency. The same is equally applicable to streams 2127/2124 and 2137/2134.

As noted above, optional heat exchanger HX2103 may be used to transfer heat from diverted exhaust stream 2111 to vapor stream 2114, thereby forming vapor stream 2115. The use of heat exchanger HX2103 is determined based upon optimization of the thermodynamic cycle 200 and other system design criteria. For example, heat transferred in heat exchanger HX2103 may be used to evaporate and remove or at least reduce the amount of moisture in vapor stream 2114 prior to 2115 combining with the remaining exhaust stream 213 and the subsequent entry of stream 214 into turbine W2112. Therefore, the use of heat exchanger HX2103 may be determined in part by the use of moisture separator MS250.

After exiting from heat exchanger HX2103, if used, vapor stream 2115 is combined with the remaining exhaust stream 213 to form stream 214, which is used as feed to the second turbine W2112 in the turbine train. It should be appreciated that the combination of vapor stream 2115 and the remaining exhaust stream 213 may be accomplished by any means known in the art depending upon the conditions of each of these streams, such as where one stream is at a lower pressure than the other. For example, an eductor, a valve arrangement, or any combination of the two may be used.

Vapor stream 214 is then expanded in the second turbine W2112 to produce usable energy (not shown) and exhaust stream 215. As with the first exhaust stream 211, exhaust stream 215 passes through moisture separator MS221 to remove or at least reduce the amount of any liquid droplets or moisture in stream 215. The removed liquid forms stream 2120 and is sent to heat exchanger HX24, and the remaining exhaust stream forms stream 216.

Similarly to moisture separator MS220, it should be appreciated that the use of moisture separator MS221 is optional. Further, while shown at the outlet of turbine W2112, moisture separator MS221 may optionally be placed in other positions in the exhaust stream from turbine W2112. For example, moisture separator MS221 may be placed in stream 217 downstream of where diverted bleed stream 2121 is diverted from the exhaust stream. Alternatively, moisture separator MS221 may be placed in stream 218 downstream of where the returning vapor stream 2125 is combined with the remaining exhaust stream 217. The position of moisture separator MS221 depends upon optimization of the cycle 200 and the position where is it most efficient and advantageous to remove any liquid from the exhaust streams represented by streams 216–218 prior to entering the third turbine W2113. It should be appreciated that placing moisture separator MS221 in stream 217 may result in lower equipment cost since the flow rate of stream 217 is lower than either streams 215 or 218. However, such placement would again be determined based upon optimization of the cycle 200.

A portion of, or bleed stream from, the remaining exhaust stream 216 is then diverted as stream 2121, and the remaining exhaust stream continues as stream 217. Generally, the amount of diverted stream 2121 is determined based upon the heat duty of heat exchanger HX24. It should be appreciated that the location of moisture separator MS221, if used, may influence the amount of the diverted stream 2121 and the design of heat exchanger HX24. The diversion of stream 2121 and achieving the desired flow rate may be accomplished by any means known in the art, such as, for example, through use of an eductor, a valve arrangement, or any combination of the two.

The diverted exhaust stream 2121 is passed to heat exchanger HX2104, which may be used to transfer heat to the returning vapor stream 2124 from exhaust stream 2121, thereby forming stream 2122. It should be appreciated that the use of heat exchanger HX2104 is optional and is discussed in more detail below. Stream 2122, liquid stream 2120, if moisture separator MS221 is used, and liquid stream 2113 from heat exchanger HX23, all enter heat exchanger HX24, and heat is transferred to feed stream 204, thereby forming feed stream 205. Optionally, these streams may be combined prior to entering heat exchanger HX24, or they may be fed separately to heat exchanger HX24. Similarly to heat exchanger HX23, heat is transferred to feed stream 204, and partial condensation of exhaust stream 2122 occurs thereby forming vapor stream 2127 and liquid stream 2123. Also, similar thermodynamic benefits, as discussed above in connection with heat exchanger HX23, are obtained to allow for further expansion of the working fluid and increased cycle efficiency.

As discussed above in connection with moisture separator MS250, moisture separator MS260 may optionally be used to remove, or at least reduce the amount of any remaining liquid in vapor stream 2127, thereby forming vapor stream 2124, and such liquid is sent back to heat exchanger HX24 as liquid stream 2126. The use of moisture separator MS260 is based upon the same criteria discussed in connection with moisture separator MS250.

As noted above, optional heat exchanger HX2104 may be used to transfer heat from diverted exhaust stream 2121 to vapor stream 2124, thereby forming vapor stream 2125. The use of heat exchanger HX2104 is determined based upon the same criteria as described in connection with heat exchanger HX2103.

After exiting from heat exchanger HX2104, if used, vapor stream 2125 is combined with the remaining exhaust stream 217 to form stream 218, which is used as feed to the third turbine W2113 in the turbine train. It should be appreciated that the combination of vapor stream 2125 and the remaining exhaust stream 217 may be accomplished in a manner as described in connection with the combination of vapor streams 2115 and 213.

Vapor stream 218 is then expanded in the third turbine W2113 to produce usable energy (not shown) and exhaust stream 219. As with the first and second exhaust streams 211 and 216, exhaust stream 219 passes through moisture separator MS222 to remove or at least reduce the amount of any liquid droplets or moisture present in stream 219. The removed liquid forms stream 2130 and is sent to heat exchanger HX25, and the remaining exhaust stream forms stream 220.

Similarly to moisture separators MS220 and MS221, it should be appreciated that the use of moisture separator MS222 is optional. Further, while shown at the outlet of turbine W2113, moisture separator MS222 may optionally be placed in other positions in the exhaust stream from turbine W2113. For example, moisture separator MS222 may be placed in stream 221 downstream of where diverted bleed stream 2131 is diverted from the exhaust stream. Alternatively, moisture separator MS222 may be placed in stream 222 downstream of where the returning vapor stream 2135 is combined with the remaining exhaust stream 221. The position of moisture separator MS222 depends upon optimization of the cycle 200 and the position where is it most efficient and advantageous to remove any liquid from the exhaust streams represented by streams 219–222 prior to entering the fourth turbine W2114. It should be appreciated that placing moisture separator MS222 in stream 221 may result in lower equipment cost since the flow rate of stream 221 is lower than either streams 219 or 222. However, such placement would again be determined based upon optimization of the cycle 200.

A portion of, or bleed stream from, the remaining exhaust stream 220 is then diverted as stream 2131, and the remaining exhaust stream continues as stream 221. Generally, the amount of diverted stream 2131 is determined based upon the heat duty of heat exchanger HX25. It should be appreciated that the location of moisture separator MS222, if used, may influence the amount of the diverted stream 2131 and the design of heat exchanger HX25. The diversion of stream 2131 and achieving the desired flow rate may be accomplished by any means known in the art, such as, for example, through use of an eductor, a valve arrangement, or any combination of the two.

The diverted exhaust stream 2131 is passed to heat exchanger HX2105, which may be used to transfer heat to the returning vapor stream 2134 from exhaust stream 2131, thereby forming stream 2132. It should be appreciated that the use of heat exchanger HX2105 is optional and is discussed in more detail below. Stream 2132, liquid stream 2130, if moisture separator MS222 is used, and liquid stream 2123 from heat exchanger HX24, all enter heat exchanger HX25, and heat is transferred to feed stream 203, thereby forming feed stream 204. Optionally, these streams may be combined prior to entering heat exchanger HX25, or they may be fed separately to heat exchanger HX25. Similarly to heat exchangers HX23 and HX24, heat is transferred to feed stream 203, and partial condensation of exhaust stream 2132 occurs thereby forming vapor stream 2137 and liquid stream 2133. Also, similar thermodynamic benefits, as discussed above in connection with heat exchangers HX23 and HX24, are obtained to allow for further expansion of the working fluid and increased cycle efficiency.

As discussed above in connection with moisture separators MS250 and MS260, moisture separator MS270 may optionally be used to remove, or at least reduce the amount of any remaining liquid in vapor stream 2137, thereby forming vapor stream 214, and such liquid is sent back to heat exchanger HX25 as liquid stream 2136. The use of moisture separator MS270 is based upon the same criteria discussed in connection with moisture separators MS250 and MS260.

As noted above, optional heat exchanger HX2105 may be used to transfer heat from diverted exhaust stream 2131 to vapor stream 2134, thereby forming vapor stream 2135. The use of heat exchanger HX2105 is determined based upon the same criteria as described in connection with heat exchangers HX2103 and HX2104.

After exiting from heat exchanger HX2105, if used, vapor stream 2135 is combined with the remaining exhaust stream 221 to form stream 222, which is used as feed to the fourth turbine W2114 in the turbine train. It should be appreciated that the combination of vapor stream 2135 and the remaining exhaust stream 221 may be accomplished in a manner as described in connection with the combination of vapor streams 2115 and 213 and 2125 and 217.

Vapor stream 222 is then expanded in the fourth turbine W2114 to produce usable energy (not shown) and another exhaust stream 223. The full exhaust stream 223 is then combined with liquid stream 2133 from heat exchanger HX25 to form stream 224. As noted, if heat exchanger HXR2 is used, heat is extracted from stream 224, thereby forming stream 225, which enters the condenser HXC2 to complete the main cycle 200.

It should be appreciated in connection with FIG. 2 that the process shown is exemplary. The process may contain more or less turbines in the turbine train. For example, the main cycle 200 may also be adapted for use with two, three, five, or more turbines in the turbine train. In the case of two or three turbines, each would also be generally operated similarly to turbines W2111–2113 in FIG. 2, thereby providing two or three diverted bleed streams from the respective turbine exhausts to respective heat exchangers to heat the feed stream, depending upon whether the last turbine in the turbine train is used to heat the feed stream or not. In the case of five or more turbines, the additional turbines would generally be operated in a manner similar to turbines W2112 or W2113 in FIG. 2, thereby providing four or more turbine exhaust streams from which at least a portion of, or bleed stream from, may be diverted to respective heat exchangers to heat the feed stream to the turbine train.

Further, it may not be necessary that the exhaust stream from each turbine be diverted to a heat exchanger to heat the feed stream to heater H1. For example, in some cases, it may be more thermodynamically efficient or more cost effective to simply pass the exhaust stream from one or more turbines to the next downstream turbine directly. In such instances, moisture may need to be separated from the exhaust stream prior to it entering the next turbine.

A choice between the process shown in FIG. 1, where the entire exhaust stream from a turbine is used to heat the feed stream, and FIG. 2, where only a portion of, or bleed stream from, the exhaust stream is used to heat the feed stream, may be determined based on various factors. For example, costs of the heat exchanger and moisture separations equipment and achieving an acceptable moisture content in the working fluid that is fed to each turbine.

It should be appreciated that the specific process operating conditions for the invention of FIG. 2 will be based upon each specific application. For example, overall process design, including process operating conditions such as stream flow rates, compositions, temperatures and pressures, as well as equipment design, will all be determined based upon optimization of thermodynamic efficiency or costs for each specific application, new or retrofit. Further, such design will also be based upon the thermodynamic properties of the specific working fluid used in the process. As one of skill in the art will appreciate, various factors may be limiting in such designs, such as existing equipment, and may dictate the use of certain designs and operating conditions to accommodate such limitations.

Figure 3:
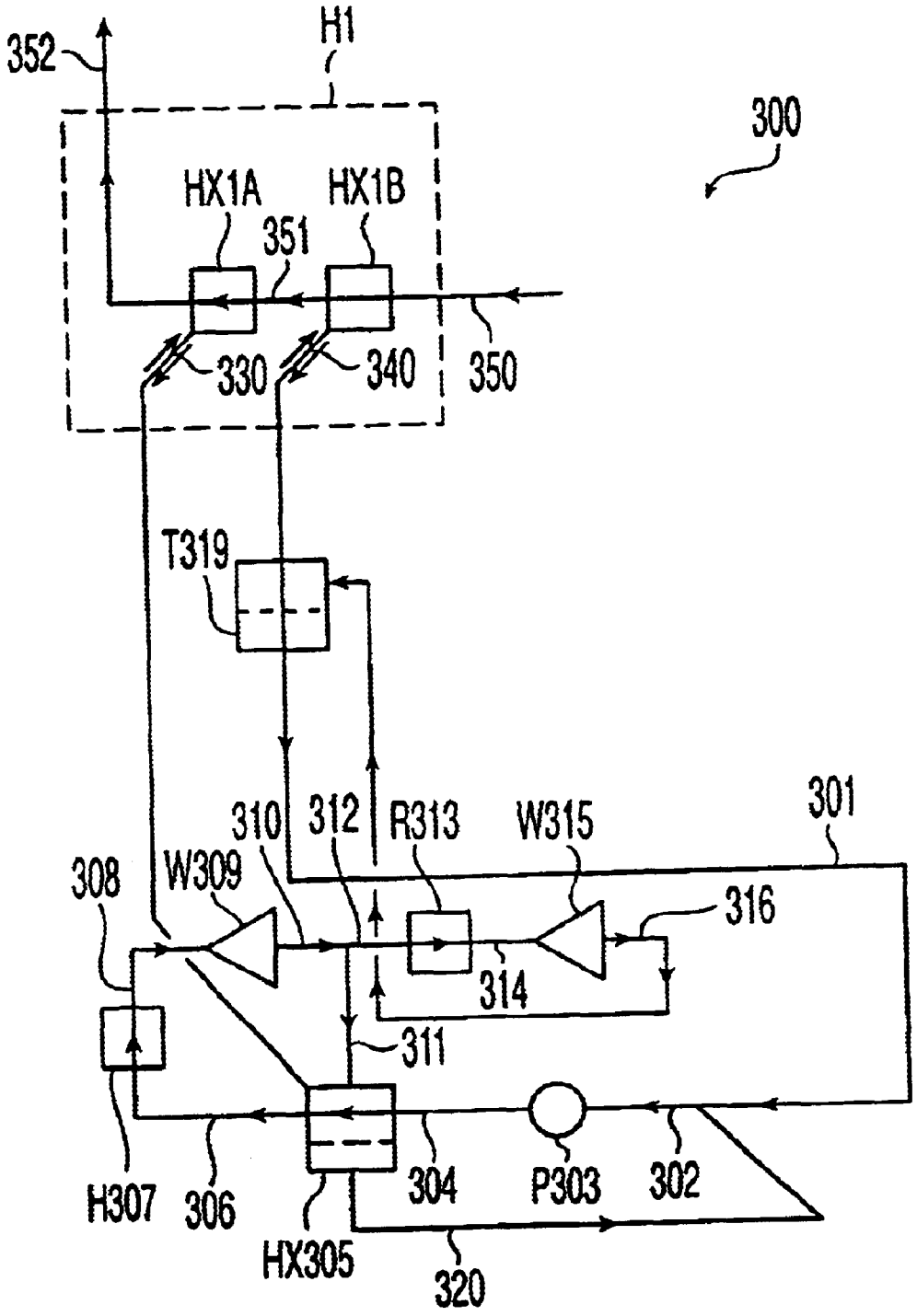
FIG. 3 illustrates a process flow schematic for a process to provide heat to the feed stream of a main thermodynamic process according to one embodiment of the present invention.

FIG. 3 illustrates a process flow schematic for a process to provide heat to the feed stream of the thermodynamic processes of FIGS. 1 and 2 according to one embodiment of the present invention. Specifically, FIG. 3 illustrates a preferred embodiment for heater H1 in FIGS. 1 and 2, which is the use of a separate thermodynamic cycle to provide heat to the feed stream of the processes shown in FIGS. 1 and 2 described above.

Heater H1 is identical to heater H1 shown in FIGS. 1 and 2. It should be appreciated the inlet and outlet streams to heater H1 are designated as streams 350 and 352; however, these streams should be viewed as generic feed streams of a main thermodynamic process according to the present invention. In this particular embodiment, heater H1 is positioned downstream of any heat exchangers that utilize any portion of an exhaust stream from a turbine in the turbine train of a main cycle to heat the feed stream that is being sent to heater H1. Therefore, streams 350 and 352 correspond in separate embodiments to streams 16 and 17 of FIG. 1 and to streams 206 and 207 of FIG. 2.

In this particular embodiment, heater H1 comprises a pair of heat exchangers HX1A and HX1B that transfer heat from a separate thermodynamic cycle 300 that is used to provide heat to the feed stream 350 of a main cycle. As noted, this separate thermodynamic cycle is referred to as a "heat-providing cycle" and may comprise any type of thermodynamic cycle from which heat can be extracted and transferred to the main cycle, such as a steam/water cycle.

In this particular embodiment, the heat-providing cycle 300 comprises a working fluid that can be construed to start through the cycle in tank T319 as a liquid. The feed stream to the turbine train, represented by two turbines W309 and W315, in the cycle 300 can be construed as following streams 301, 302, 304, 306 and 308. The working fluid in tank T319 is passed by feed stream 301 and 302 to pump P303, thereby forming feed stream 304, and is sent to heat exchanger HX305. In heat exchanger HX305, feed stream 304 is heated by stream 311, which is a diverted portion of, or bleed stream from, exhaust stream 310, thereby forming feed stream 306. Further details regarding operation of heat exchanger HX305 are discussed below.

Feed stream 306 then passes through heater H307, which transfers heat to feed stream 306, thereby forming stream 308. Heater H307 may be any type of heater, such as a boiler, particularly in the case where heat-providing cycle 300 comprises a steam/water cycle. Feed stream 308 is then fed to the turbine train, specifically to the first turbine W309 where it is expanded to produce usable energy (not shown) and exhaust stream 310.

As noted, a portion of, or bleed stream from, exhaust stream 310 is diverted as stream 311 to heat exchanger HX305. Transferring heat from diverted exhaust stream 311 to feed stream 304 forms a condensed liquid stream 320 and a vapor stream 330. Condensed liquid stream 320 is combined with feed stream 301 to form feed stream 302.

Stream 330 represents both a vapor stream being fed to heat exchanger HX1A and a condensed liquid stream returning from heat exchanger HX1A to the heat-providing cycle. The vapor stream portion of stream 330 is used as feed to heat exchanger HX1A where it transfers heat to the feed stream 351 of the main cycle. The returning condensed liquid stream portion of stream 330 is sent to heat exchanger HX305, where it is combined with any condensed liquid from stream 311 to form stream 320, which it then combined with feed stream 301 in the heat-providing cycle. Although shown as separate devices, heat exchanger HX305 may be an integral part of heat exchanger HX1A.

It should be appreciated that the flow rate or amount of vapor in stream 330 that is sent to heat exchanger HX1A is determined by the heat demand of heat exchanger HX1A. In other words, depending upon optimization of the main cycle, including the amount of heat transferred by heat exchanger HX1B, discussed below, the heat demand of heat exchanger HX1A can be determined and, therefore, the amount of vapor in stream 330.

The remainder of exhaust stream 310 is then fed as stream 312 to a reheater R313, which may be used to transfer heat to stream 312, thereby forming stream 314. It should be appreciated that reheater R313 is optional and its use is dependent upon whether stream 310 requires reheating prior to entering the second turbine W315.

Stream 314 is then expanded in turbine W315 to produce usable energy (not shown) and an exhaust stream 316. Exhaust stream 316 is passed to tank T319. Similarly to stream 330, stream 340 represents both a vapor stream being fed to heat exchanger HX1B and a condensed liquid stream returning from heat exchanger HX1B to the heat-providing cycle. The vapor in tank T319 forms the vapor portion of stream 340 and is sent to heat exchanger HX1B where it transfers heat to the feed stream 350 of the main cycle. The returning liquid stream is sent back to tank T319 and is used to form feed stream 301, thereby completing the closed-loop cycle for the working fluid of the heat-providing cycle. Similarly to heat exchanger HX1A, the heat demand of heat exchanger HX1B can be determine through optimization of the main cycle, which will allow determination of the amount of vapor that is required in the vapor portion of stream 340. Although shown as separate devices, tank T319 and heat exchanger HX1B may be physically connected.

It should be appreciated that the heat-providing cycle shown in FIG. 3 is exemplary. Any type of thermodynamic cycle may be used to provide heat to the main cycle. Further, while FIG. 3 uses a heat-providing cycle having a turbine train that comprises two turbines, more or less turbines may be used. For example, a heat-providing cycle having one, three, four, five, or more turbines may also be used. In these cases, the number of points where a vapor stream, such as streams 330 and 340 in FIG. 3, may be extracted can be reduced or increased, and the number of heat exchangers used to transfer heat to the feed stream of the main cycle, such as heat exchangers HX1A and HX1B would also be reduced or increased, respectively. If the heat-providing cycle had three turbines, then three vapor stream extractions could be possible, where the additional turbine would operate in a fashion similar to turbine W309 in FIG. 3. Further, if four turbines were used in the heat-providing cycle, then four extractions would be possible, where the two additional turbines would also operate similarly to turbine W309 in FIG. 3, and so on.

It should further be appreciated that the combination of FIG. 1 and FIG. 3 provides a composite cycle comprising a main cycle having a turbine train with four turbines and three fully diverted exhaust streams that transfer heat to the feed stream to that turbine train and a heat-providing cycle having two turbines and, therefore, two extractions from that cycle that also provide heat to the feed stream for the main cycle turbine train. Since the number of turbines in both the main cycle and the heat-providing cycle may be altered, many different combinations for composite cycles can be utilized. For example, the main cycle may have 3 turbines that provide two fully diverted exhaust streams to heat the feed stream to this turbine train. This feed stream may receive heat from a heat-providing cycle that has one, two, or three turbines, which would provide one, two, or three vapor streams for such heating. As another example, the main cycle may be as shown in FIG. 1 and have four turbines in the turbine train that provide three fully diverted exhaust streams to heat the feed stream to this turbine train. This feed stream may receive heat from a heat-providing cycle that has one, two, three, four, or more turbines, which would provide one, two, three, four, or more corresponding vapor streams for such heating. It should be appreciated that other combinations may be used for integrating the main cycle and the heat-providing cycle. The optimization of the main cycle can be used to determine the best method for integrating the two cycles.

It should further be appreciated that the combination of FIG. 2 and FIG. 3 also provides a composite cycle comprising a main cycle having a turbine train with four turbines and three exhaust streams from which at least respective portions, or bleed streams, are used to transfer heat to the feed stream to that turbine train and a heat-providing cycle having two turbines and, therefore, two extractions from that cycle that also provide heat to the feed stream for the main cycle turbine train. Since the number of turbines in both the main cycle and the heat-providing cycle may be altered, many different combinations for composite cycles can be utilized. For example, the main cycle may have 3 turbines that provide two partially diverted exhaust streams to heat the feed stream to this turbine train. This feed stream may receive heat from a heat-providing cycle that has one, two, or three turbines, which would provide one, two, or three vapor streams for such heating. As another example, the main cycle may be as shown in FIG. 2 and have four turbines in the turbine train that provide three partially diverted exhaust streams to heat the feed stream to this turbine train. This feed stream may receive heat from a heat-providing cycle that has one, two, three, or four turbines, which would provide one, two, three, or four vapor streams for such heating. It should be appreciated that other combinations may be used for integrating the main cycle and the heat-providing cycle. The optimization of the composite cycle can be used to determine the best method for integrating the two cycles.

It should be appreciated that the specific process operating conditions for the process of FIG. 3, along with its combination with either FIG. 1 or 2, will be based upon each specific application. For example, overall process design, including process operating conditions such as stream flow rates, compositions, temperatures and pressures, as well as equipment design, will all be determined based upon optimization of thermodynamic efficiency or costs for each specific application, new or retrofit. Further, such design will also be based upon the thermodynamic properties of the specific working fluid used in the process. As one of skill in the art will appreciate, various factors may be limiting in retrofit designs, such as existing equipment, and may dictate the use of certain designs and operating conditions to accommodate such limitations.

Figure 3A:
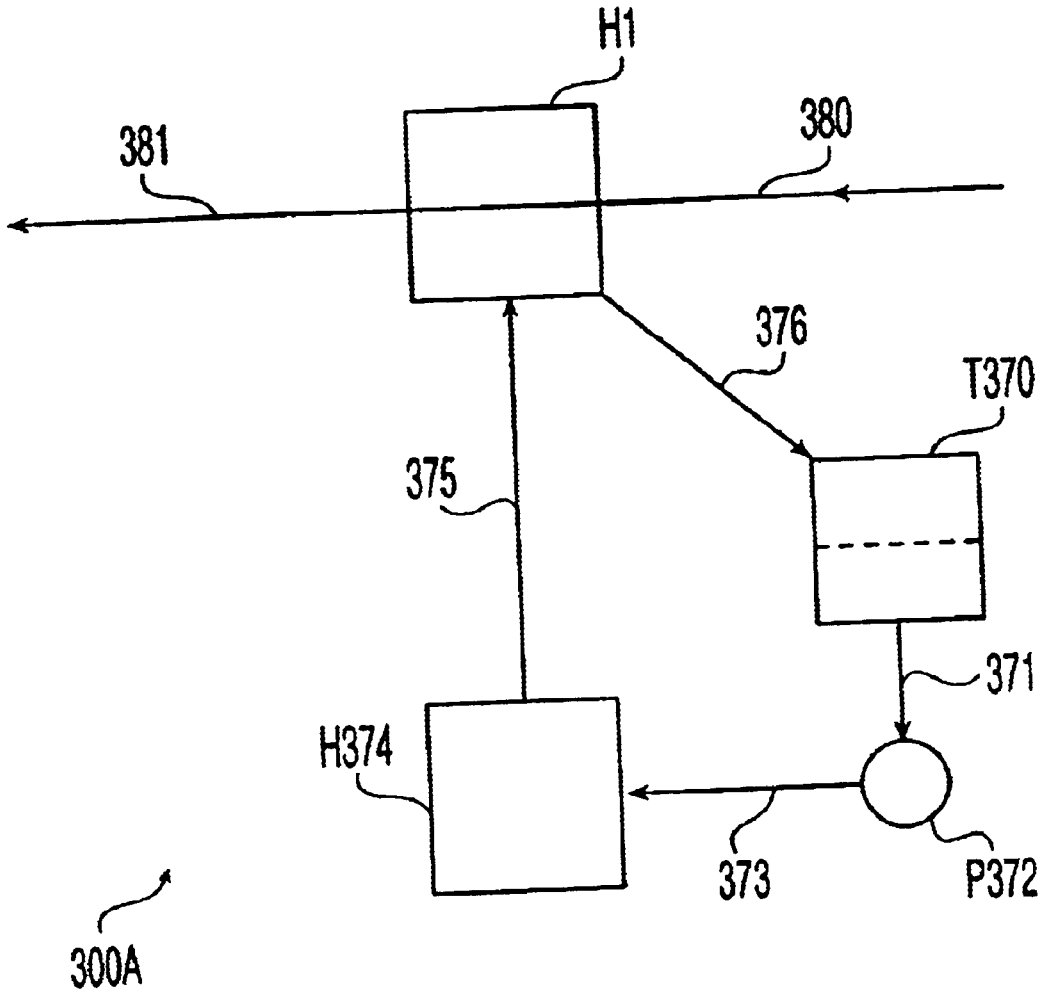
FIG. 3A illustrates a process flow schematic for a process to provide heat to the feed stream of a main thermodynamic process according to another embodiment of the present invention.

FIG. 3A illustrates a process flow schematic for a process to provide heat to the feed stream of a main thermodynamic process according to another embodiment of the present invention. In this embodiment, heater H1 comprises a heat exchanger that receives heat from a heat-providing circuit 300A. It should be appreciated that this embodiment is not referred to as a heat-providing cycle because heat-providing circuit 300A is not a thermodynamic cycle as no usable energy is separately produced. More specifically, in heat-providing circuit 300A, the temperature of the working fluid that is used to provide heat to the main cycle, may be insufficient to support both operation of a turbine and the provision of heat to the main cycle. Therefore, heat from the working fluid is transferred directly to the main cycle heater H1.

It should be appreciated that similarly to FIG. 3, heater H1 is identical to heater H1 shown in FIGS. 1 and 2. It should be appreciated the inlet and outlet streams to heater H1 are designated as streams 380 and 381; however, these streams should be viewed as generic feed streams of a main thermodynamic process according to the present invention. In this particular embodiment, heater H1 is positioned downstream of any heat exchangers that utilize any portion of an exhaust stream from a turbine in the turbine train of a main cycle to heat the feed stream that is being sent to heater H1. Therefore, streams 380 and 381 correspond in separate embodiments to streams 16 and 17 of FIG. 1 and to streams 206 and 207 of FIG. 2.

In this embodiment, the working fluid may be construed as starting in tank T370 as a liquid. The working fluid in tank T370 is passed as stream 371 through pump P372, thereby forming stream 373. This stream is the feed stream to heater H374, which is any type of heater capable of evaporating, and in some instances superheating, feed stream 373 to form vapor stream 375. It should be appreciated that heater H374 may be a boiler, particularly in the case where heat-providing circuit 300A uses water/steam as the working fluid. Heater H374 may be a fossil or renewable fuel-fired heat source, a nuclear power heat source, a geothermal heat source, a solar energy heat source, a waste heat recovery source, and combinations of the foregoing. Preferably, heater H374 may be a nuclearpowered boiler, waste incinerator, or a geothermal heat source.

Vapor stream 375 is then passed to heater H1 and transfers heat through a heat exchanger to feed stream 380 of the main cycle, thereby forming condensed stream 376, which is returned to tank T370 to complete the heat-providing circuit. Although shown as separate devices, tank T370 may be an integral part of heater H1.

It should be appreciated that the specific process operating conditions for the process of FIG. 3A, along with its combination with either FIG. 1 or 2, will be based upon each specific application. For example, overall process design, including process operating conditions such as stream flow rates, compositions, temperatures and pressures, as well as equipment design, will all be determined based upon optimization of thermodynamic efficiency or costs for each specific application, new or retrofit. Further, such design will also be based upon the thermodynamic properties of the specific working fluid used in the process. As one of skill in the art will appreciate, various factors may be limiting in retrofit designs, such as existing equipment, and may dictate the use of certain designs and operating conditions to accommodate such limitations.

Figure 4:
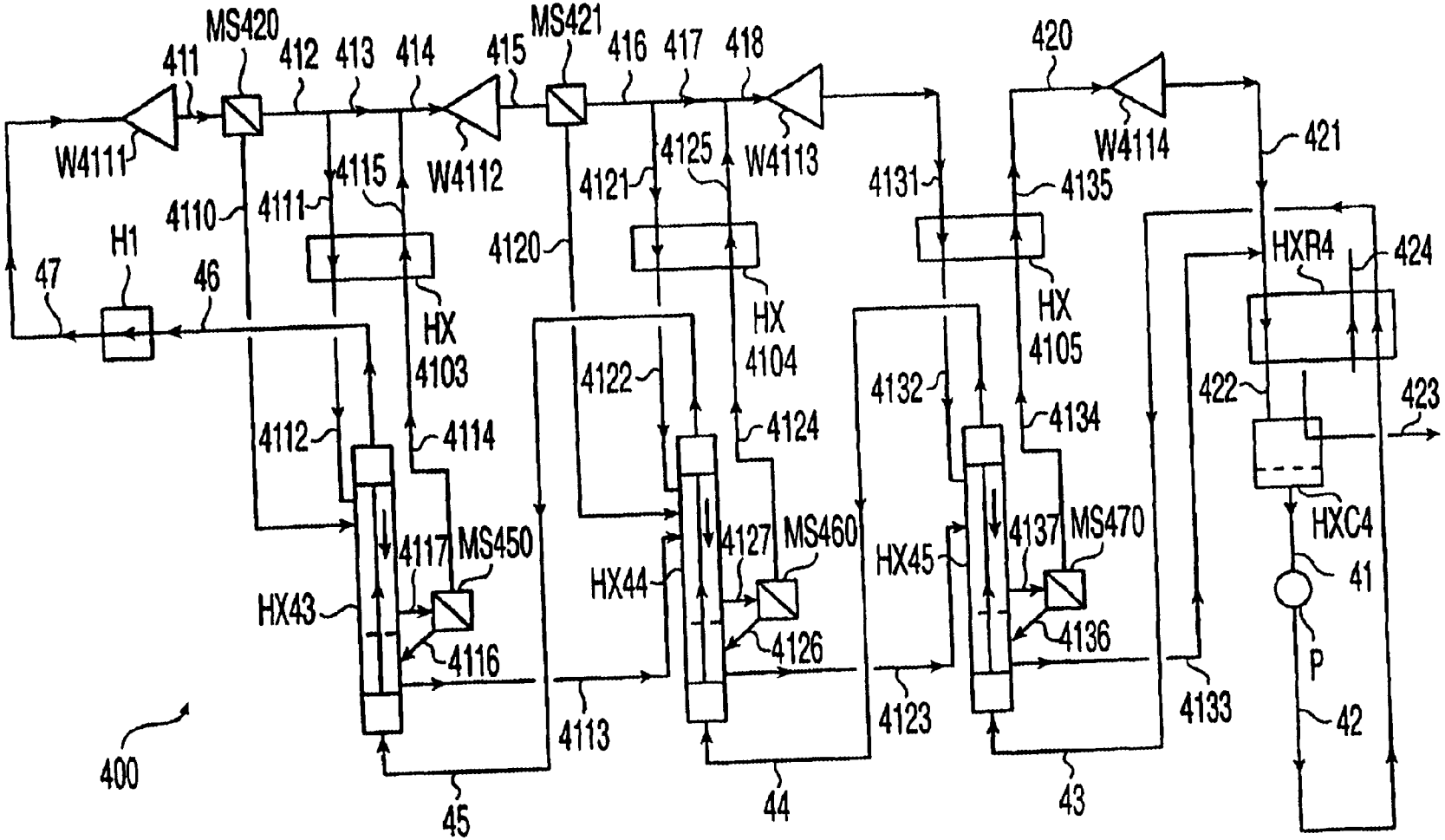
FIG. 4 illustrates a process flow schematic of a thermodynamic process according to another embodiment of the present invention.

FIG. 4 illustrates a process flow schematic of a thermodynamic process according to another embodiment of the present invention. FIG. 4 is basically a combination of the processes described in connection with FIGS. 1 and 2. FIG. 1 illustrated a thermodynamic process in which the full exhaust stream from a turbine is diverted to provide heat to the feed stream to heater H1. FIG. 2 illustrated a thermodynamic process in which a portion of, or bleed stream from, an exhaust stream from a turbine is diverted to provide heat to the feed stream to heater H1. FIG. 4 illustrates a combination of these uses of the exhaust stream from a turbine. The overall flow schematic is similar to both FIGS. 1 and 2. As shown, however, the first two turbines W4111 and W4112 generate exhaust streams 411 and 415, respectively. As described in connection with FIG. 2, these exhaust streams may pass through moisture separators MS420 and MS421, respectively, and the operation and location of these moisture separators is similar to those described in connection with FIG. 2. Also similar to FIG. 2, only a portion or bleed stream from exhaust streams 412 and 416 are diverted as streams 4111 and 4121. The operation and use of heat exchangers HX4103 and HX4104 are similar to those described in connection with FIG. 2. Streams 4111/4112 and 4121/4122 are passed to heat exchangers HX43 and HX44, respectively, to heat the feed stream to heater H1 in a manner as described in connection with FIG. 2. The operation of heat exchangers HX43 and HX44 is similar to those described in connection with FIG. 2.

Unlike FIG. 2, however, but similarly to FIG. 1, the full exhaust stream 4131 from the third turbine W4113 is diverted. Again, the operation and use of heat exchanger HX4105 is similar to that described in connection with FIG. 1. Stream 4131/4132 is passed to heat exchanger HX45 and used to heat the feed stream to heater H1. The operation of heat exchanger HX45 is similar to that described in connection with FIG. 1.

Therefore, the process of FIG. 4 utilizes a combination of diverting both portions of, or bleed streams from, certain turbine exhaust streams and diverting full exhaust streams from other turbines in the same turbine train. While one specific combination is shown in FIG. 4, it should be appreciated that other combinations are possible. Moreover, since fewer or more turbines may be used in the turbine train, even more combinations are possible. The specific combinations used would be determined from the thermodynamic or economic optimization of the cycle.

It should be appreciated that the specific process operating conditions for the process of FIG. 4, will be based upon each specific application. For example, overall process design, including process operating conditions such as stream flow rates, compositions, temperatures and pressures, as well as equipment design, will all be determined based upon optimization of thermodynamic efficiency or costs for each specific application, new or retrofit. Further, such design will also be based upon the thermodynamic properties of the specific working fluid used in the process. As one of skill in the art will appreciate, various factors may be limiting in retrofit designs, such as existing equipment, and may dictate the use of certain designs and operating conditions to accommodate such limitations.

While the foregoing description and drawings represent the preferred embodiments of the present invention, it will be understood that various additions, modifications and substitutions may be made therein without departing from the spirit and scope of the present invention as defined in the accompanying claims. In particular, it will be clear to those skilled in the art that the present invention may be embodied in other specific forms, structures, arrangements, proportions, and with other elements, materials, and components, without departing from the spirit or essential characteristics thereof. The presently disclosed embodiments are therefore to be considered in all respects as illustrative and not restrictive, the scope of the invention being indicated by the appended claims, and not limited to the foregoing description.

For example, it is to be understood that although the invention has been described using as an example an ammonia/water process as the main cycle and a water/steam process as a heat-providing cycle, other cycles may be used. Moreover, it is to be understood that although the invention has been described as using certain numbers of turbines in each cycle, different numbers of turbines may be used in both the main and the heat-providing cycles, thereby allowing for many different integrations of the two cycles. For example, different numbers of full exhaust or bleed streams from turbines in the main cycle may be used to heat the feed stream to that turbine train. Similarly, different numbers of turbines may be used in the heat-providing cycle, thereby allowing for different numbers of extractions of vapor streams from the heat-providing cycle to provide heat to the feed stream for the main cycle.

What is claimed is:

1. A process for producing energy through a thermodynamic cycle comprising:

transforming a first working fluid having at least two components into usable energy and a first exhaust stream;

diverting at least a portion of the first exhaust stream to form a diverted first exhaust stream;

transferring heat from the diverted first exhaust stream to the first working fluid, thereby partially condensing the diverted first exhaust stream to form a partially condensed diverted first exhaust stream;

separating the partially condensed diverted first exhaust stream into a vapor stream and a liquid stream; and transforming the vapor stream into usable energy.

2. The process of claim 1, further comprising combining the vapor stream with the first exhaust stream to form a second working fluid and wherein the transforming of the vapor stream into usable energy comprises transforming the second working fluid into usable energy.

3. The process of claim 2, wherein the first and second working fluids each comprise mixtures of water and ammonia.

4. The process of claim 2, wherein the transforming the first working fluid comprises expanding the first working fluid in a first turbine and the transforming of the second working fluid comprises expanding the second working fluid in a second turbine.

5. The process of claim 2, wherein the transforming of the second working fluid into usable energy comprises transforming the second working fluid into usable energy and a second exhaust stream; and further comprising:

diverting at least a portion of the second exhaust stream to form a diverted second exhaust stream;

combining the diverted second exhaust stream with the liquid stream to form a combined stream; and transferring heat from the combined stream to the first working fluid prior to the transforming the first working fluid into usable energy.

6. The process of claim 5, wherein the transferring heat from the combined stream to the first working fluid comprises partially condensing the combined stream to form a partially condensed combined stream;

separating the partially condensed combined stream into a second vapor stream and a second liquid stream; and transforming the second vapor stream into usable energy.

7. The process of claim 1, wherein the combining the vapor stream with the first exhaust stream is facilitated by a device selected from the group consisting of an eductor, a valve arrangement, and combination thereof.

8. The process of claim 1, further comprising transferring heat from the diverted first exhaust stream to the vapor stream before the combining of the vapor stream with the first exhaust stream.

9. The process of claim 1, further comprising returning the liquid stream to the first working fluid.

10. The process of claim 1, wherein the transforming the first working fluid comprises:

transferring heat to the first working fluid from a heat source; and expanding the first working fluid in a turbine, thereby producing the usable energy and the first exhaust stream.

11. The process of claim 10, wherein the heat source is selected from the group consisting of a fossil fuel, a renewable fuel, a nuclear fuel, geothermal energy, solar energy, and combinations thereof.

12. The process of claim 10, wherein the transferring heat to the first working fluid comprises transferring heat from a heat-providing thermodynamic cycle.

13. The process of claim 12, wherein the heat-providing thermodynamic cycle comprises:

transforming a first heat-providing working fluid into usable energy and a first heat-providing exhaust stream;

diverting at least a portion of the first heat-providing exhaust stream to form a diverted first heat-providing exhaust stream; and transferring heat from the diverted first heat-providing exhaust stream to the first working fluid.

14. The process of claim 13, wherein the first heat-providing working fluid comprises a mixture of water and steam.

15. The process of claim 13, wherein the transferring heat from the diverted first heat-providing exhaust stream to the first working fluid comprises evaporating at least a portion of the first working fluid.

16. The process of claim 13, wherein the transferring heat from the diverted first heat-providing exhaust stream to the first working fluid comprises superheating the first working fluid.

17. The process of claim 13, wherein the transferring heat from the diverted first exhaust stream to the first working fluid comprises at least partially vaporizing the first working fluid to form a vaporous first working fluid and wherein the transferring heat from a heat-providing thermodynamic cycle comprises superheating the vaporous first working fluid.

18. The process of claim 1, further comprising separating at least a portion of any moisture from the first exhaust stream before the diverting of at least a portion of the first exhaust stream.

19. The process of claim 1, wherein the at least a portion of the first exhaust stream comprises the entire first exhaust stream.

20. The process of claim 19, wherein the transforming of the vapor stream into usable energy comprises transforming the vapor stream into usable energy and a second exhaust stream; and further comprising:

diverting at least a portion of the second exhaust stream to form a diverted second exhaust stream; and transferring heat from the diverted second exhaust stream and the liquid stream to the first working fluid.

21. The process of claim 20, wherein the transferring heat from the combined stream to the first working fluid comprises at least partially condensing the combined stream to form a partially condensed combined stream;

separating the partially condensed combined stream into a second vapor stream and a second liquid stream; and transforming the second vapor stream into usable energy.

22. The process of claim 19, further comprising transferring heat from the diverted first exhaust stream to the vapor stream before the combining of the vapor stream with the first exhaust stream.

23. The process of claim 19, further comprising returning the liquid stream to the first working fluid.

24. The process of claim 19, wherein the transforming the first working fluid comprises:

transferring heat to the first working fluid from a heat source; and expanding the first working fluid in a turbine, thereby producing the usable energy and the first exhaust stream.

25. The process of claim 24, wherein the heat source is selected from the group consisting a fossil fuel, a renewable fuel, a nuclear fuel, geothermal energy, solar energy, and combinations thereof.

26. The process of claim 24, wherein the transferring heat to the first working fluid comprises transferring heat from a heat-providing thermodynamic cycle.

27. The process of claim 26, wherein the heat-providing thermodynamic cycle comprises:

transforming a first heat-providing working fluid into usable energy and a first heat-providing exhaust stream;

diverting at least a portion of the first heat-providing exhaust stream to form a diverted first heat-providing exhaust stream; and transferring heat from the diverted first heat-providing exhaust stream to the first working fluid.

28. The process of claim 27, wherein the first heat-providing working fluid comprises a mixture of water and steam.

29. The process of claim 27, wherein the transferring heat from the diverted first heat-providing exhaust stream to the first working fluid comprises evaporating at least a portion of the first working fluid.

30. The process of claim 27, wherein the transferring heat from the diverted first heat-providing exhaust stream to the first working fluid comprises superheating the first working fluid.

31. The process of claim 27, wherein the transferring heat from the diverted first exhaust stream to the first working fluid comprises at least partially vaporizing the first working fluid to form a vaporous first working fluid and wherein the transferring heat from a heat-providing thermodynamic cycle comprises superheating the vaporous first working fluid.

32. The process of claim 19, further comprising separating at least a portion of any moisture from the first exhaust stream before the diverting of at least a portion of the first exhaust stream.

* * * * *